United States Patent [19]

Tate

[11] 4,326,629

[45] Apr. 27, 1982

[54] BOTTLE CARRIER

[76] Inventor: Benjamin Tate, 1422 Irwin Dr., Erie, Pa. 16505

[21] Appl. No.: 142,383

[22] Filed: Apr. 21, 1980

[51] Int. Cl.[3] ..... B65D 81/26; B65D 1/24; B65D 25/04

[52] U.S. Cl. ..... 206/203; 206/427; 220/21

[58] Field of Search ..... 220/21; 206/203, 427

[56] References Cited

U.S. PATENT DOCUMENTS

| | | | |
|---|---|---|---|
| D. 256,434 | 8/1980 | O'Donnal | 206/203 |
| 3,142,407 | 7/1964 | Poupitch | 206/203 |
| 3,480,178 | 11/1969 | Mogan | 220/21 |
| 3,888,348 | 6/1975 | Frey | 206/427 |
| 3,927,789 | 12/1975 | Prodel | 220/21 |
| 3,991,879 | 11/1976 | Hirota | 206/203 |
| 4,036,391 | 7/1977 | Prodel | 220/21 |
| 4,256,224 | 3/1981 | Hirota | 206/427 |

FOREIGN PATENT DOCUMENTS

| | | | |
|---|---|---|---|
| 2017645 | 10/1979 | United Kingdom | 220/21 |

*Primary Examiner*—George E. Lowrance

[57] ABSTRACT

A bottle carrier, four of which fit into one crate, is disclosed. The bottle carrier has a rectangular frame around the top connected at its four corners having a partition bar extending across from one side to the other which can function as a handle. Four bottom members are spaced downwardly from the frame. Each bottom member fits into one compartment of the crate. Each of the four members have a separate part and radially extending arms attached to the central parts. The arms are attached to the downwardly extending support members that extend upwardly and are attached to the frame. Two of the downwardly extending members on each side are closely spaced to each other and receive partitions in a crate therebetween.

1 Claim, 5 Drawing Figures

FIG 4
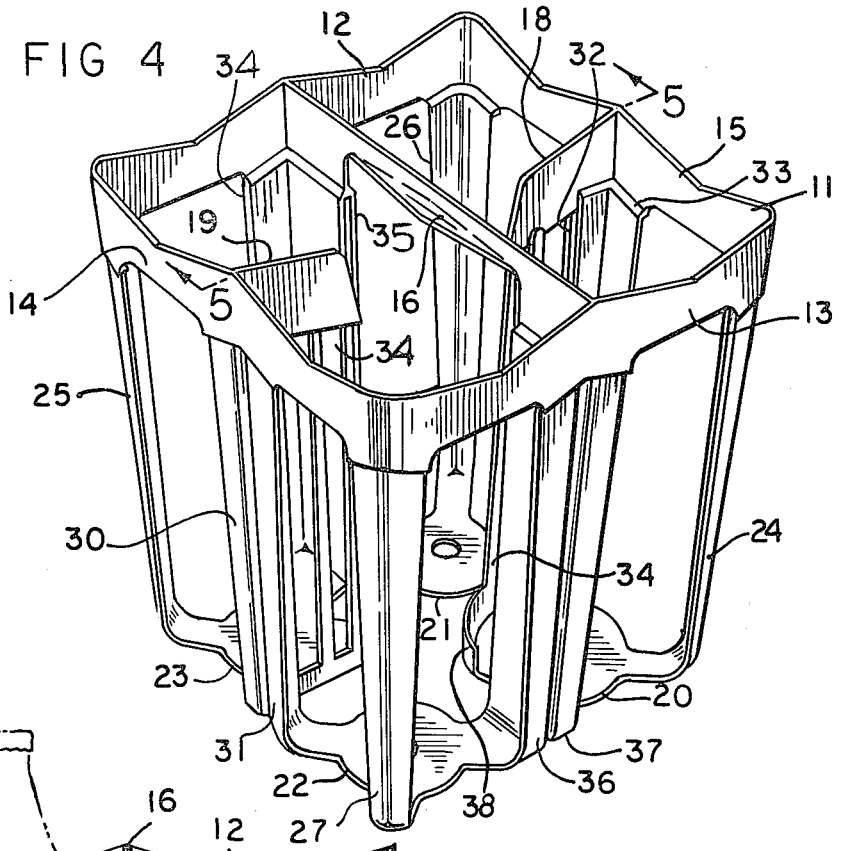
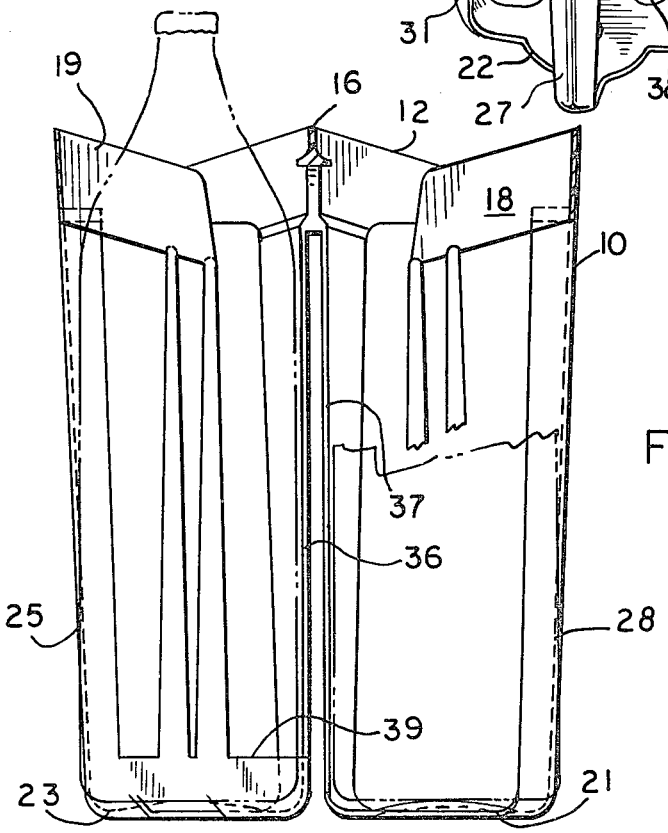
FIG 5

BOTTLE CARRIER

REFERENCE TO PRIOR ART

Previous patents of the general type disclosed herein are shown in U.S. Pat. No. 3,283,947 and 3,991,879. However, none of these bottle carriers are suitable for use with a crate as disclosed herein.

OBJECTS OF THE INVENTION

It is an object of the invention to provide an improved bottle carrier.

Another object of the invention is to provide a bottle carrier that is simple in construction, economical to manufacture and simple and efficient to use.

Another object of the invention is to provide a bottle carrier in combination with a bottle crate.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 4 is an isometric view of the bottle carrier.

FIG. 5 is a cross section view of the bottle carrier taken along line 5—5 of FIG. 4.

DETAILED DESCRIPTION OF THE DRAWINGS

Figure 1:
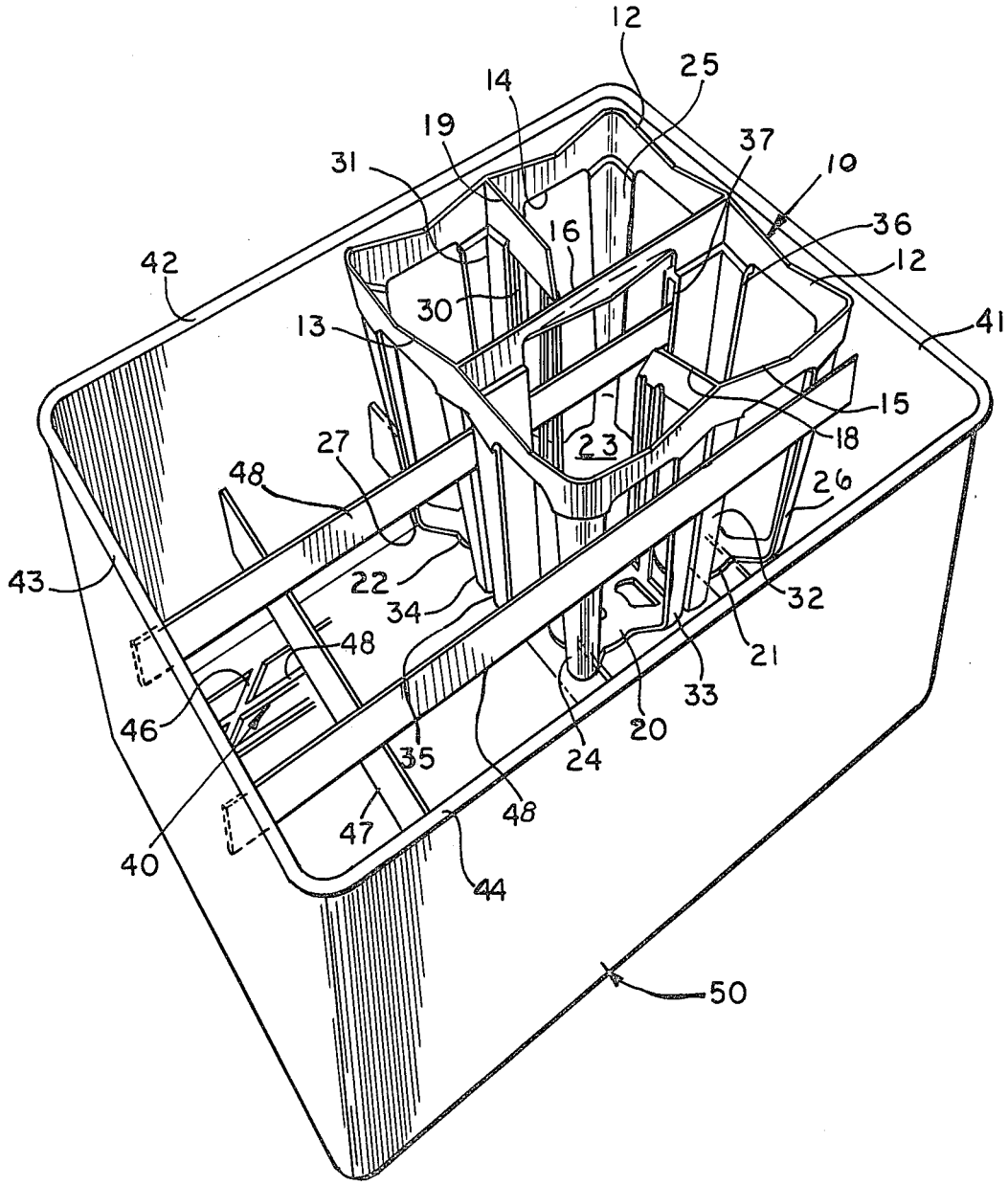
FIG. 1 is an isometric view showing a bottle carrier according to the invention supported in a bottle crate.
Figure 2:
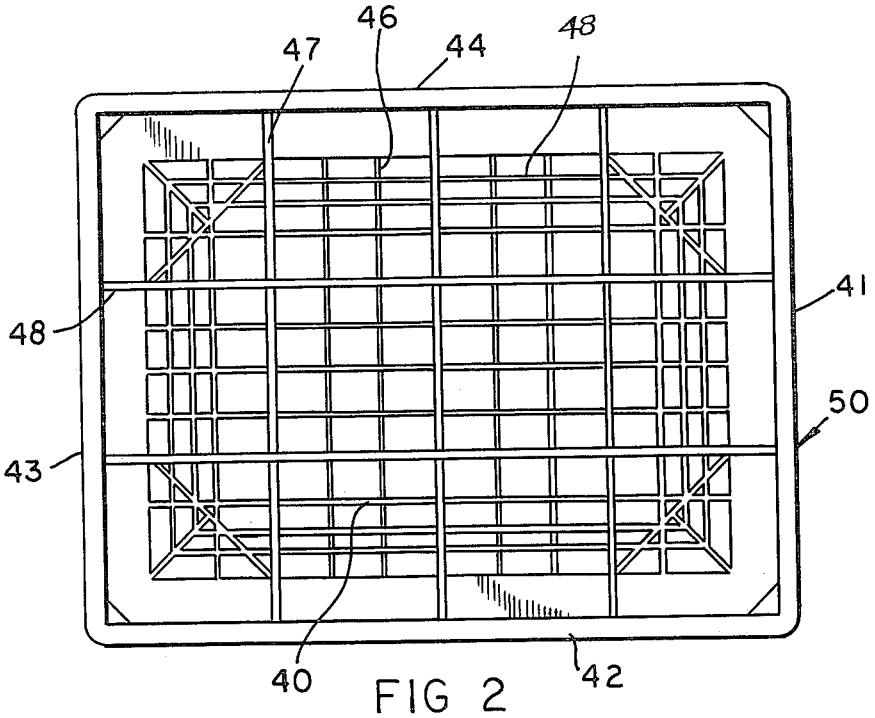
FIG. 2 shows a top view of a crate suitable for use with the bottom of the carrier according to the invention.
Figure 3:
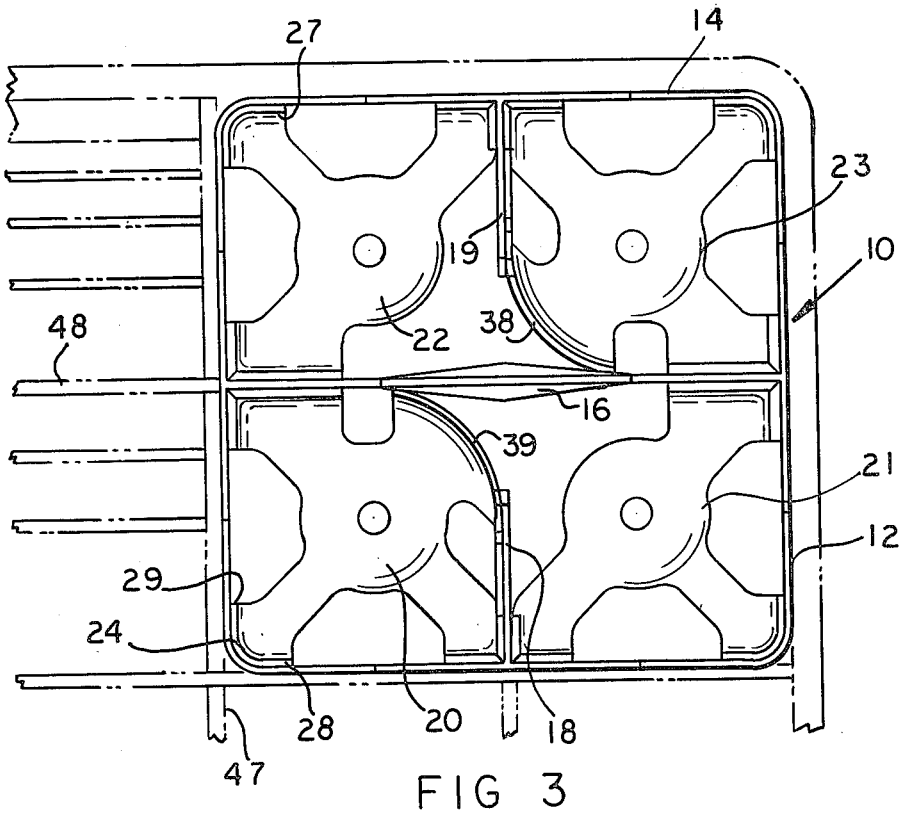
FIG. 3 is a top view of the bottle carrier.

Now with more particular reference to the drawings, the carrier 10 is shown for transporting four bottles, cans and the like. Two each containing four carton carriers 10 and four one-half gallon cartons of milk can be placed in each crate 50 as will be later described. Each carrier 10 has a rectangular frame 11 and four side walls 12, 13, 14 and 15 integrally connected together at the corners. A partition bar 16 is attached to sides 12 and 13 and extended across the top of the carrier and can be used as a handle for lifting the carriers out of the crate and for carrying. A second partition 18 extends inwardly from the end wall 15 and a third partition 19 extends inwardly from end wall 14 in cantilever fashion. The carrier has four bottom members 20, 21, 22 and 23 on each of which one carton of milk rests and have radially extending arms as shown.

The corner members 24, 25, 27 and 28 are connected to the corners of the frame 11 and extend downwardly and then curve inwardly and are attached to the bottom members 20, 23, 22 and 21 respectively. Two closely spaced intermediate members 30 and 31 are attached to the end wall 14 extending downwardly and curving inwardly and are attached to the bottom members 22 and 23 respectively. Members 30 and 31 are spaced from each other and provide a space which receives one of the partitions 47 and 48. Similar downwardly extending members 32 and 33 are attached to end wall 15 and downwardly extending members 34 and 35 are attached to side wall 13 and are attached to bottom members 20 and 22 and members 36 and 37 are attached to end wall 12, extend downwardly and are attached to the bottom members 22 and 23 in the same manner as in connecting with members 30 and 31.

The upwardly extending flange 38 is attached to the bottom member 20 and is curved upwardly and is attached to intermediate member 34 and a similar flange 39 is attached to the bottom member 20 and to the intermediate member 18.

The crate 50 has bottom 40 and four sides 41, 42, 43 and 44 and a bottom made up of ribs. The bottom 40 is made up of cross members 46 and 48 that are integrally attached to the ends and sides. It will be noted that the partitions 47 and 48 divide the crate into square compartments and two carriers 10 fit into the crate 50 together with four one-half gallon cartons of milk. The partitions 47 and 48 of the crate are received in the spaces between downwardly extending members 30, 31, 32, 33, 34, 35, 36 and 37 of the carrier 10.

The cross member 16 forms a convenient handle for lifting each carrier 10 out of its compartment. Each carrier 10 is capable of carrying four bottoms one in each compartment.

It will be noted that the members 24, 25, 27 28, 30, 31, 32, 33, 34, 35, 36 and 37 are all angular in cross section, this provides strength to these members and also provides a convenient way of attaching these members to the flanges of the bottles and to the frame to strengthen it.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A carrier comprising a frame (10) a first side, a second side, a third side and a fourth side (12, 13, 14, 15) arranged in rectangular pattern integrally connected together at their corners.

a first partition attached to said second side and said fourth side, and extending inwardly therebetween, a second partition and a third partition, said second partition being attached to said first side and extending inwardly towards said first partition in cantilever fashion and terminating short of said first partition, a third partition integrally attached to said third side and extending inwardly toward said first partition and terminating short thereof, four spaced bottom members below said frame and arranged in a rectangular pattern with one said bottom member below each said corner, or said corner members integrally attached to said sides and extending downward therefrom, one said corner member being attached to each said bottom member, four pairs of spaced intermediate members, one pair of said intermediate member being attached to each said side and extending downwardly therefrom, each said intermediate member being attached to a said bottom member, each pair of said intermediate members being attached to two adjacent said bottom members, each pair of said intermediate members defining a space therebetween for receiving a partition of a crate, two said bottom members that are diametrically opposite each other having an extending flange on the side thereof, opposite said corner member attached thereto, and a downward extending member attached to each said second partition and said third partition and attached to said flange on the said diagonally opposite bottoms.

* * * * *